US005228214A

United States Patent [19]

Biancalani et al.

[11] Patent Number: 5,228,214

[45] Date of Patent: Jul. 20, 1993

[54] APPARATUS FOR THE CONTINUOUS TREATMENT OF A LINEAR MANUFACTURE

[75] Inventors: Fiorenzo Biancalani, Florence; Luigi Marcora, Vicchio, both of Italy

[73] Assignees: Officina Meccanica Biancalani; C. di Fiorenzo Biancalani & C. S.n.c.; Coramtex S.r.l., all of Florence, Italy

[21] Appl. No.: 821,955

[22] Filed: Jan. 15, 1992

[30] Foreign Application Priority Data

Jan. 18, 1991 [IT] Italy ..... FI/91/A17

[51] Int. Cl.[5] ..... F26B 13/10

[52] U.S. Cl. ..... 34/126; 34/162; 34/129; 34/131; 68/5 D

[58] Field of Search ..... 34/126, 129, 130, 131, 34/135, 136, 141, 142, 162, 151, 152, 155, 38, 203, 216, 219; 68/5 D, 5 R, 20; 26/18.5; 8/149.2

[56] References Cited

U.S. PATENT DOCUMENTS

| | | | |
|---|---|---|---|
| 2,311,824 | 2/1943 | Gautreau | 34/131 |
| 2,661,520 | 12/1953 | Hamilton et al. | 26/18.5 |
| 3,509,639 | 5/1970 | Arendt | 34/129 |
| 3,815,257 | 6/1974 | Freze | 34/129 |
| 3,831,294 | 8/1974 | Freze | 34/131 |
| 3,938,356 | 2/1976 | Arendt | 68/5 D |
| 4,010,550 | 3/1977 | Freze | 34/33 |
| 4,109,493 | 8/1978 | Hugenbruch | 34/129 |

*Primary Examiner*—Henry A. Bennett
*Assistant Examiner*—Denise L. Gromada
*Attorney, Agent, or Firm*—McGlew and Tuttle

[57] ABSTRACT

The apparatus—which is used for the continuous treatment of a linear manufacture, such as length of fabric to be dried, with a gaseous stream - comprises a hollow rotor device (3) capable of being set in angular motion about a substantially horizontal axis, in combination with means (16, 14) for feeding the manufacture (M) to an open end of said rotor and means (42) for drawing the manufacture from the other open end of said rotor; continuous conveyor belt means (65, 65A) extend through the rotor in order to slowly advance said manufacture inside the internal volume of the rotor along said rotor; and suitable means (22, 30, 9) pass conditioned air or some other treatment gas into and along said rotor in order to treat the material.

5 Claims, 4 Drawing Sheets

APPARATUS FOR THE CONTINUOUS TREATMENT OF A LINEAR MANUFACTURE

SUMMARY AND OBJECTIONS OF THE INVENTION

The object of the invention is to make possible a continuous treatment of a manufacture—such as a fabric or the like—of indefinite length, uniformly and regularly and with the possibility of a variety of adjustments.

These and other objects and advantages will be clear from the following text.

The present apparatus—for the continuous treatment of a linear manufacture, such as a length of fabric to be dried, with a gaseous stream—comprises in combination: a hollow rotor device, capable of being set in angular motion about a substantially horizontal axis; means for feeding the manufacture to an open end of said rotor and means for drawing the manufacture from the other open end of said rotor; continuous conveyor belt means extending along said rotor in order to slowly advance said manufacture inside the internal volume of the rotor and along said rotor; and means for passing conditioned air or some other treatment gas into and along said rotor in order to treat the material during the angular movement of said rotor and the consequent movement of the portion of manufacture present and temporarily piled up inside the rotor device.

The rotor may comprise at least one or two conveyor belts with their internal driving sides adjacent and inclined with respect to each other; other walls complete the volume through which the manufacture moves in said rotor, between the two open ends thereof. The apparatus may comprise less or more than two continuous conveyor belts, or even enough of these to define the volume of the rotor.

The rotor device is set in alternating angular motion about its own axis.

Drive means are provided for the advance of the conveyor belt(s) and hence for the slow advance of the manufacture piled up inside the internal volume of the rotor. Said drive means may act when the rotor is at rest, or may act at suitable times during the alternating movement of the rotor in either of the two directions, with toothed means in Maltese Cross form or the like and with unidirectional mechanisms so as to bring about advance in the desired direction only of the conveyor(s). Operation of the rotor may be programed too, as an alternative, to stop the rotor temporarily in a position in which the conveyor belt(s) is/are found in the bottom of the rotor volume, and hence driving the manufacture; clutch means are provided to activate said conveyor belts during said periods of rest.

The means for passing air through and along the rotor may comprise a blower and an external recycling circuit, comprising a partial exhaust and an air intake including a suction unit, heating means and suchlike means of conditioning the air in circulation. The air may be passed around counter-currentwise or with the current.

A unit may also be provided for pneumatically drawing in the manufacture as it arrives, to facilitate its introduction into the rotor's internal volume.

BRIEF DESCRIPTION OF THE DRAWINGS

The invention will be understood more clearly by following the description and the accompanying drawing, which latter shows a practical, non-limiting embodiment of said invention. In the drawing.

DETAILED DESCRIPTION OF THE PREFERRED EMBODIMENT

Figure 1:
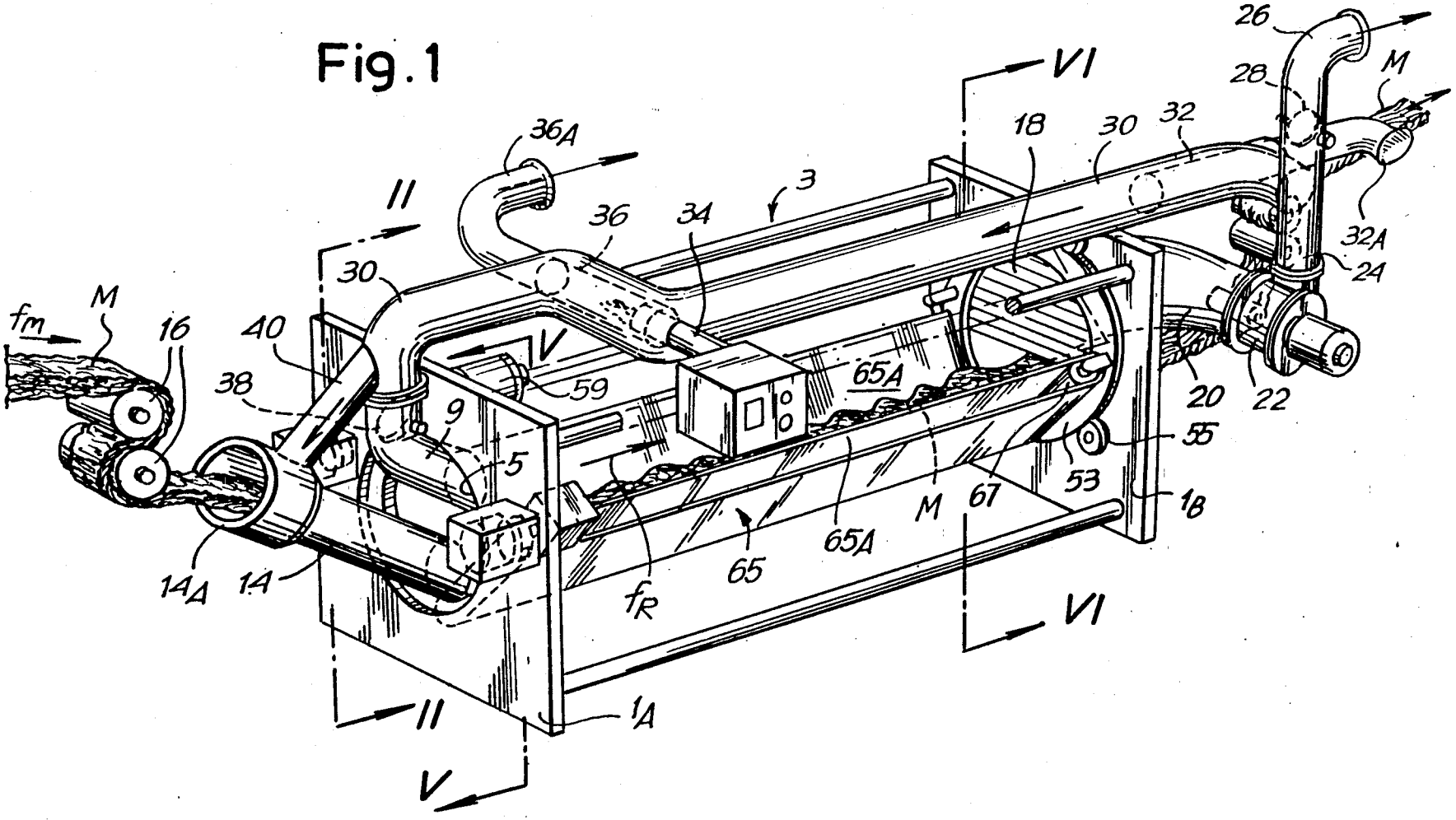
FIG. 1 shows a general perspective view of the internal and working parts of the apparatus.
Figure 3:
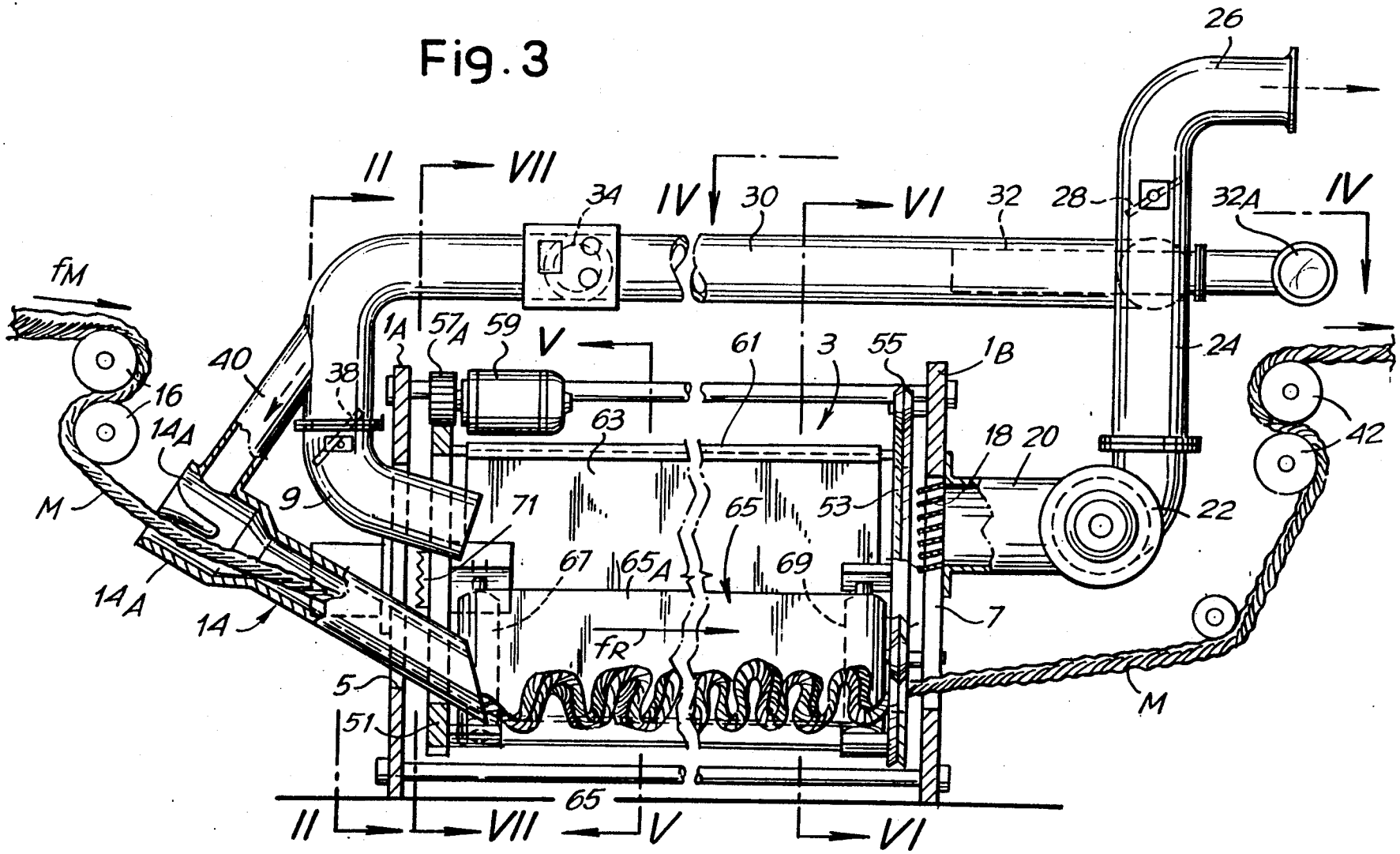
FIG. 3 shows a general vertical longitudinal cross-section.
Figure 4:
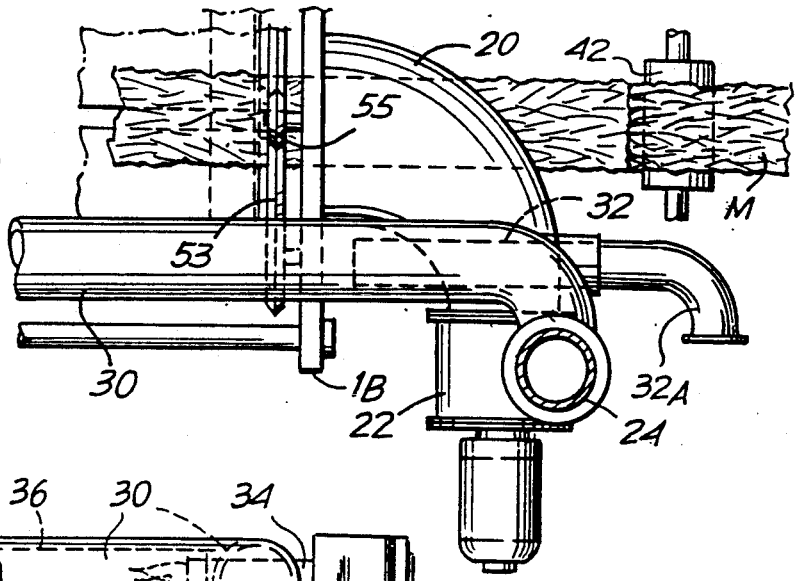
FIG. 4 shows a diagrammatic plan view taken through the line IV—IV of FIG. 3.
Figure 4:
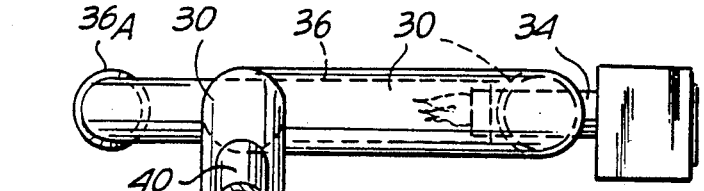
Figure 2:
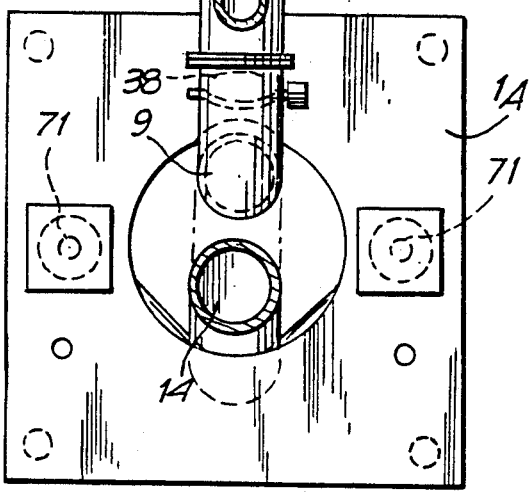
FIG. 2 shows an end view in section taken through the line II—II of FIG. 1.
Figure 5:
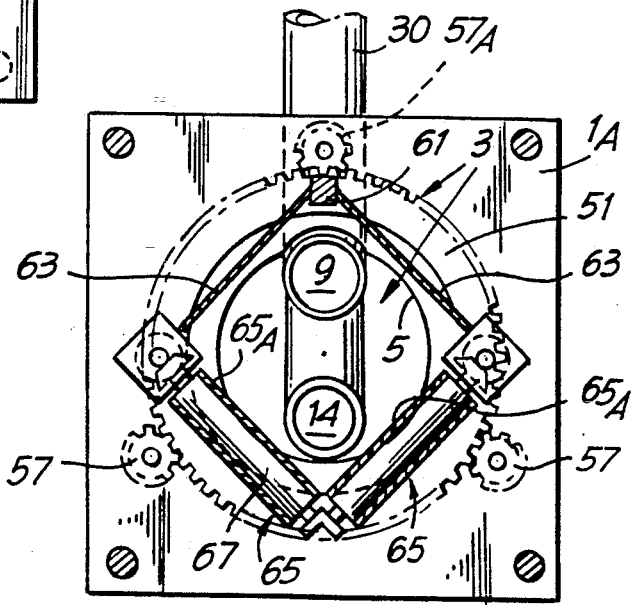
FIGS. 5 and 6 show transverse sectional views taken, respectively, through V—V and VI—VI of FIGS. 1 and 3.
Figure 6:
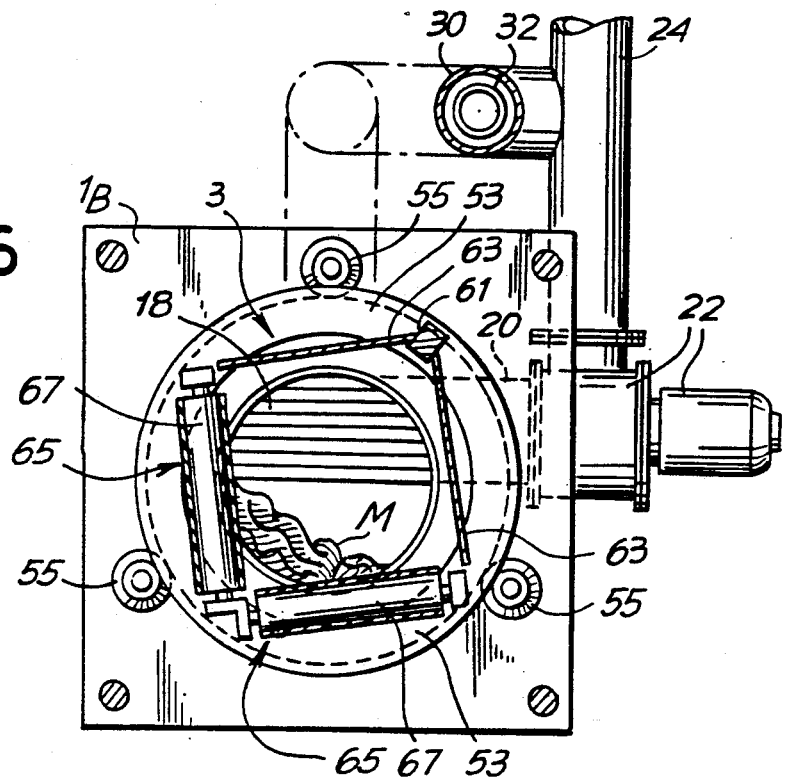
Figure 7:
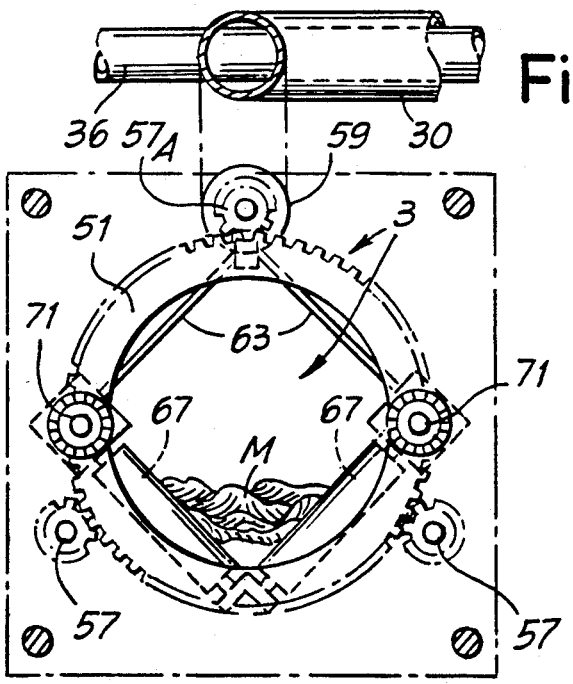
FIG. 7 shows a partial perspective view of the input end of the complex through which the fabric moves.

As depicted in the accompanying drawing, generally indicates a frame which should be suitably encased and comprises internally a rotor on a horizontal axis indicated generally by 3, which extends between the endplates 1A and 1B for the input and output, respectively, of the length of material to be treated by drying and by any other finishing treatment. In particular the endplate 1A has an input port 5 and the endplate 1B has an output port 7; a terminal mouth 9 of the hot air intake duct 10 enters the rotor 3 through the upper part of the port 5; through the lower part of the intake port 5 there enters a passage 14 for the input of the continuous length of material indicated by M and fed in the direction of the arrow fM by feeder units comprising a pair of feeder rolls 16, after which pair of rolls the material M enters through the input mouth 14A of the passage 14 for input of the material into the rotor 3. From the upper part of the output port 7 of the endplate IB, through a grating 18, the air that has traveled through the rotor 3 is drawn out by a suction duct 20; the air is drawn by an air circulating blower indicated generally by 22. 24 indicates the delivery duct of the blower 22 and this duct subdivides into an exhaust line 26 controlled by a throttle valve 28 and a recycling line 30 which leads to the mouth 9. Along the recycling duct 30 is a partial supply of fresh air through a connection 32 admitting air from an air intake 32A: this fresh air can be drawn in by the same stream of air set up by the blower 22 in the duct 30. The duct 30 is also equipped with an air heater, shown diagrammatically by a burner 34, whose exhaust gases cross a section of the duct 30, being conveyed by a combustion chamber 36, and are discharged outside by a duct 36A. The duct 30 in the connection with the mouth 9 feeding into the rotor 3 may be more or less throttled by means of a throttle valve 38 so as to regulate the fraction of air blown at pressure and diverted from the duct 30 into a take-off duct 40 which feeds a stream of air into the passage 14, 14A in order pneumatically to draw in the material M, which is thus more easily passed into the rotor 3 through the lower part of the input port 5. The material M is treated during its transit and agitation inside the rotor 3, being manipulated in the manner and with the members to be described pertaining to said rotor, and is withdrawn through the lower part of the port 7 of the endplate 1B, the drawing out being done in a suitable manner, for example by a pair of drawing rolls 42. Thus the material M, fed in the direction of the arrow fM, passes through the input passage 14, through the rotor 3 at a limited speed owing to its being piled up, and is drawn out by the unit 42. The air travels from the blower 22 into the duct 24, the duct 30 and the mouth 9, and the air is heated by the unit 34, 36; a limited amount of the air is renewed, some being removed through the exhaust 26 and some fresh air being drawn in through the intake 32A, 32; the blown air which is to reach the rotor 3 can in part be diverted into the take-off duct 40 in order to assist in advancing the material M through the passage 14. At the intake 32A a blower may be provided to introduce air from the outside when the exhaust from the mouth 26 is high.

The circulation of the air may also be reversed, in order to act, that is, counter-currentwise rather than with the current.

The rotor 3, which extends between the two endplates 1A and 1B, comprises two annular cheeks 51 and 53 whose internal apertures correspond substantially to the ports 5 and 7 of said endplates 1A and IB; the periphery of the annular cheek 51 is developed in the form of a toothed rim, while the periphery of the annular cheek 53 is shaped with an annular groove; said peripheral annular groove in the annular cheek 53 is used to engage the cheek 53 in a plurality of rollers 55 carried by the endplate 1B, vertically and axially securing the annular cheek 53 while allowing it to rotate. Interacting with the peripheral toothed rim of the annular cheek 51 are toothed pinions 57 whose function is to support the annular cheek 51 vertically, and one of these for example the upper one 57A—is also driven by a motor 59 to allow the rotation, with the pinion 57A, of the toothed rim of the annular cheek 51 and of the whole rotor 3; the motion of the rotor will alternate. The two annular cheeks 51 and 53 are connected together—to form the main skeleton of the rotor 3—by means of suitable connection means as generally and partially indicated by 61. Also forming part of the rotor 3 are two dihedrally arranged fixed walls 63 (which may also be perforated) to enable the air to circulate and to guide it as it does so. Two further walls,-which together with the walls 63 define the internal volume of the rotor for the passage of the material M, are formed by the internal driving sides of two conveyor belts 65 which run between rolls 67 adjacent to the tooth-rimmed annular cheek 51 and rolls 69 adjacent to the grooved annular cheek 53; said rolls are supported by the adjacent annular cheeks. In short, a transit chamber for the material M in the rotor 3 is formed by the dihedrally arranged walls 63 and by the internal driving sides 65A of the continuous conveyor belts 65 which run between the rolls 67 and 69. The rolls 67 may be rotated by means of dog clutches 71 and by bevel gear wheels; the clutches 71 will be activatable at suitable times in a predetermined position of the rotor 3 by means of power take-offs arranged on the endplate A. It is also possible to provide a single dog clutch 71 at a point between the two rolls 67 in order, by means of a multiple bevel-gear-and-pinion transmission, to give simultaneous drive to the two drive rolls 67 of the conveyor belts 65. The dog clutch or clutches 71 are driven in a predetermined angular position of rest of the rotor 3 that is symmetrical with respect to a vertical plane, so that the two continuous conveyor belts are at the bottom in this position while the two walls 63 are at the top. In this position of the rotor, clearly, the material rests on the conveyor belts 65 and these conveyor belts 65 will be driven in order that the internal driving sides 65A of these conveyor belts may be able to advance the material in the direction of the arrow fR within the rotor 3. The power take-offs for the dog clutch(es) 71 may as appropriate be retracted or arranged in any other way to enable the rotor to rotate. The rotor is periodically driven to produce an alternating rotation one or more times for one or more revolutions for the treatment of the material that is inside the chamber of the rotor defined by the walls 63 and conveyor belts 65, 65A, as effected by the motor 59 which is driven as appropriate in opposing directions so as to rotate the pinion 57A and hence the toothed rim of the annular cheek 51 and thus the whole rotor. As the material M inside the rotor is moved along, therefore, it is lifted up and allowed to drop back with non-repetitive movements of the material owing to the action of the continuous reversals of rotation of the rotor. This makes it possible for the air to act efficiently as it passes through the rotor moving between the mouth 9 and the shutter 18 and so giving a desired treatment to the material M which- stays for a comparatively long time inside the rotor. The material is advanced intermittently by the conveyor belts during the brief rest periods when the rotor is in the symmetrical position with the conveyor belts 65, 65A at the bottom of said rotor. The speed with which the material M is fed in and drawn out is greater than the speed with which it advances inside the rotor, and the material therefore piles up and remains inside the rotor to undergo its treatment.

The direction of movement of the air may be the same as indicated by fR for the movement of the material M, but it would also be possible to arrange the air to circulate counter-currentwise with respect to the material as already mentioned.

Figure 8:
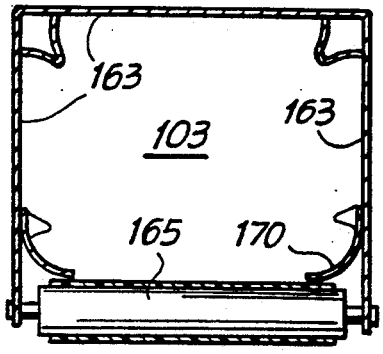
FIG. 8 shows an alternative embodiment in section.

FIG. 8 provides an alternative embodiment in which walls 163 define the hollow rotor 103 together with a single conveyor belt 165 which must be in the position indicated in the drawing while advancing. The walls 163 may have sealing strips 170 in contact with the driving side of the conveyor belt 165.

In short, a practically continuous treatment is achieved of the length of material—whether fabric or non-fabric—in order to dry it and/or apply any other treatments of conditioning and finishing, including contraction (that is shrinking) and/or stabilizing of the fibers, owing to the absence of tension and to the particular movement imparted to the fabric.

It will be understood that the drawing shows only an illustrative embodiment which is given purely as a practical demonstration of the invention, it being possible for said invention to vary as regards shapes and arrangements without thereby departing from the scope of the concept underlying said invention. Any reference numbers appearing in the accompanying claims are intended to facilitate the reading of the claims with reference to the description and drawing, and do not limit the scope of protection represented by the claims. For example, two apparatuses may be set up in series, with means of monitoring the transit inside them.

We claim:

1. An apparatus for continuous treatment of a linear article of manufacture, comprising:

a hollow rotor supported for angular motion about a substantially horizontal axis, said rotor including an input opening and an output opening; article of manufacture feeding means for feeding the article of manufacture to said input opening of said rotor; drawing means for drawing the article of manufacture from the output opening of said rotor; conveyor means including a continuous conveyor belt extending within said rotor for slow advance of the article of manufacture piled up inside an interior of said rotor, between said input opening and said output opening; treatment gas means for passing treatment gas through said interior of said rotor for treatment of the article of manufacture during angular motion of said rotor and during a consequent movement of a portion of the article of manufacture piled inside said interior of said rotor; and drive means connected to said rotor for imparting said angular motion to said rotor and for stopping said rotor in a position in which said conveyor belt is at a lower side of said interior of said rotor with the article of manufacture piled thereon.

2. An apparatus according to claim 1, wherein said conveyor means includes said conveyor belt and an additional conveyor belt, said conveyor belt and said additional conveyor belt being inclined with respect to each other with internal driving sides adjacent to each other, said rotor including outer walls cooperating with said conveyor belt and said additional conveyor belt to define said rotor interior whereby said article of manufacture moves in said rotor interior between said input opening and said output opening.

3. An apparatus according to claim 1, wherein said conveyor means includes a plurality of conveyor belts.

4. An apparatus according to claim 1, wherein said drive means alternately moves said rotor in either of two angular motion directions, said drive means including tooth means engaging cooperating teeth provided about a periphery of said rotor.

5. An apparatus according to claim 1, wherein said drive means includes clutch means for activating said conveyor belts in said lower most position.

* * * * *